US005762781A

United States Patent [19]

Bodnaras

[11] Patent Number: 5,762,781

[45] Date of Patent: Jun. 9, 1998

[54] FLOTATION APPARATUS AND PROCESS

[75] Inventor: George Bodnaras, Western Australia, Australia

[73] Assignee: Atomaer Pty. Ltd., Australia

[21] Appl. No.: 652,919

[22] Filed: May 24, 1996

Related U.S. Application Data

[63] Continuation-in-part of Ser. No. 64,108, filed as PCT/AU91/00548 Nov. 25, 1991, Pat. No. 5,591,328.

[30] Foreign Application Priority Data

Nov. 23, 1990 [AU] Australia ..... PK3534

[51] Int. Cl.[6] ..... B03D 1/24; B01F 3/04

[52] U.S. Cl. ..... 209/170; 209/168; 209/164; 210/220; 210/221.2; 210/703

[58] Field of Search ..... 209/164, 168, 209/169, 170; 210/220, 221.2, 703

[56] References Cited

U.S. PATENT DOCUMENTS

| | | |
|---|---|---|
| 1,847,659 | 3/1932 | MacClennan . |
| 2,002,964 | 5/1935 | Sheeler . |
| 2,142,207 | 1/1939 | Price . |
| 2,145,269 | 1/1939 | Munro . |
| 2,922,521 | 1/1960 | Schrauz . |
| 3,012,669 | 12/1961 | Ziemer . |
| 3,192,155 | 6/1965 | Bready . |
| 3,719,278 | 3/1973 | Kolfertz . |
| 4,253,271 | 3/1981 | Raymond . |
| 4,490,248 | 12/1984 | Filippov . |
| 4,834,872 | 5/1989 | Overath . |
| 5,542,546 | 8/1996 | Gotte . |
| 5,591,328 | 1/1997 | Bodnaras . |

FOREIGN PATENT DOCUMENTS

| | | |
|---|---|---|
| 89/10201 | 11/1989 | WIPO . |

*Primary Examiner*—Thomas M. Lithgow
*Attorney, Agent, or Firm*—Michael Best & Friedrich

[57] ABSTRACT

A flotation apparatus including: an elongate vertical riser (142) in which a cocurrent flow of gas/slurry liquid mixture rises upwards to a discharge mouth at its top end; an aeration unit (140) provided at a lower end of the riser; a separation unit (150) provided at the top end of the riser; and wherein the height of the riser is selected to produce substantially turbulence free flow in which a high gas lift occurs in the riser such that a pressure drop between the liquid inlet and the discharge outlet of the aeration unit is sufficient to produce gas particle dispersion and recirculation of the slurry liquid through the flotation apparatus.

10 Claims, 5 Drawing Sheets

FLOTATION APPARATUS AND PROCESS

CROSS-REFERENCE TO RELATED APPLICATIONS

This application is a continuation-in-part of U.S. patent application Ser. No. 08/064,108 filed on 24 May 1993 now U.S. Pat. No. 5,591,328 entitled Gas Particle Formation, which was the U.S. National Phase of International application No. PCT/AU91/00548 filed on 25 Nov., 1991 and which claimed Convention priority from Australian Application No. PK3534 filed on 23 Nov., 1990. The above applications are incorporated herein by reference.

FIELD OF THE INVENTION

The present invention relates to a flotation process and apparatus and relates particularly, though not exclusively, to aeration of a liquid/slurry in mineral flotation apparatus.

BACKGROUND TO THE INVENTION

U.S. Ser. No. 08/064,108 describes a method and apparatus for gas particle formation in which the desired size of gas particles can be readily controlled and a relatively uniform distribution of gas particles can be achieved irrespective of the gas flow rates required by the process. Also described is a flotation apparatus and process which employs the gas dispersion unit or aerator to generate gas particle dispersion and recirculation of the slurry.

Froth flotation is a process typically used for concentrating values from low-grade ores. After/during fine grinding the ore is mixed with water to form a slurry. Chemicals are added to the slurry to preferentially develop differences in surface characteristics between the various mineral species present. The slurry is then copiously aerated and the preferred (hydrophobic) mineral species cling to bubbles and float as a mineralised froth which is removed for further processing.

It is well established that a key factor in the performance of the flotation technique is the size, volume and distribution of gas particles or air bubbles that can be dispersed into the slurry. If a large volume of gas particles can be injected into and uniformly distributed throughout the slurry a high gas lift is produced.

The aeration unit of U.S. Ser. No. 08/064,108 demonstrated that if a high gas lift is maintained, sufficient pressure drop can be produced between the liquid inlet and the discharge outlet of the aeration unit to generate gas particle dispersion as well as recirculation of the slurry through the flotation apparatus, thereby using the gas energy to drive the process. It has been realised that this way of operating a flotation apparatus and process is not limited to using the particular aeration unit described in U.S. Ser. No. 08/064,108. Any suitable aeration unit that is capable of generating similar high air lift values can be employed to achieve the same effect.

SUMMARY OF THE INVENTION

According to one aspect of the present invention there is provided a flotation apparatus comprising:

an elongate vertical riser having an aeration unit for aerating a cocurrent flow of gas/slurry mixture rising upwards in the riser, the aeration unit having a liquid inlet and a discharge outlet; and means for generating substantially turbulence free flow in which a high gas lift occurs in said riser such that a pressure drop between the liquid inlet and the discharge outlet of the aeration unit is sufficient to produce gas particular dispersion and recirculation of the surry through the flotation apparatus.

Preferably the apparatus further comprises a reactor vessel provided between the aeration unit and the riser, said reactor vessel having a larger cross-sectional area than said riser wherein the reactor is adapted to facilitate uniform gas dispersion, in use, but to minimise recombination of gas particles in a gas/slurry mixture formed therein.

Advantageously the riser has a flared end section at its upper end adapted to further slow down the flow of the gas/slurry mixture rising in the riser whereby, in use, the mixture slows down sufficiently for gas particles in the form of froth to separate from the slurry liquid at a discharge mouth of the riser. Typically said riser discharges into a separation unit of the apparatus in which gas particles in the form of froth are separated from the slurry liquid, and wherein the separated slurry liquid recovered from the separation unit can be recirculated through the aeration unit to increase the probability of values attachment to the gas particles.

According to another aspect of the present invention there is provided a flotation process comprising the steps of:

aerating a cocurrent flow of gas/slurry mixture rising upwards in an elongate vertical riser;

generating substantially turbulence free flow in which a high gas lift occurs in said riser from gas particles formed by an aeration unit;

generating a pressure drop between a liquid inlet and a discharge outlet of the aeration unit which is sufficient to produce gas particle dispersion and recirculation of the slurry through the flotation apparatus, thereby using the gas energy to drive the process.

Preferably the process further comprises the step of facilitating uniform gas dispersion whilst inhibiting recombination of gas particles adjacent the discharge outlet of the aeration unit, such that most of the kinetic energy of the gas particles is dispersed before they enter the riser.

Typically the process further comprises the steps of further slowing down the flow of gas/slurry mixture rising in the riser as it approaches a discharge mouth of the riser, and separating gas particles in the form of froth from unattached slurry liquid at the discharge mouth of the riser.

Advantageously the process further comprises the step of recirculating the separated slurry liquid through the aeration unit such that the volume of slurry liquid recirculated is between 4 to 20 times the slurry feed flow, thereby increasing the probability of values attachment to the gas particles.

Although the following description will be given primarily with reference to a flotation apparatus and process for concentrating values from low grade ores, it should be understood that the invention also applies to other types of flotation apparatus and processes such as that used for concentrating values when de-inking paper pulp or separating oil from slurry.

BRIEF DESCRIPTION OF THE DRAWINGS

In order that the nature of the present invention may be more clearly ascertained preferred embodiments will now be described in detail, by way of example only, with reference to the accompanying drawings, in which.

DETAILED DESCRIPTION OF PREFERRED EMBODIMENTS

Figure 1:
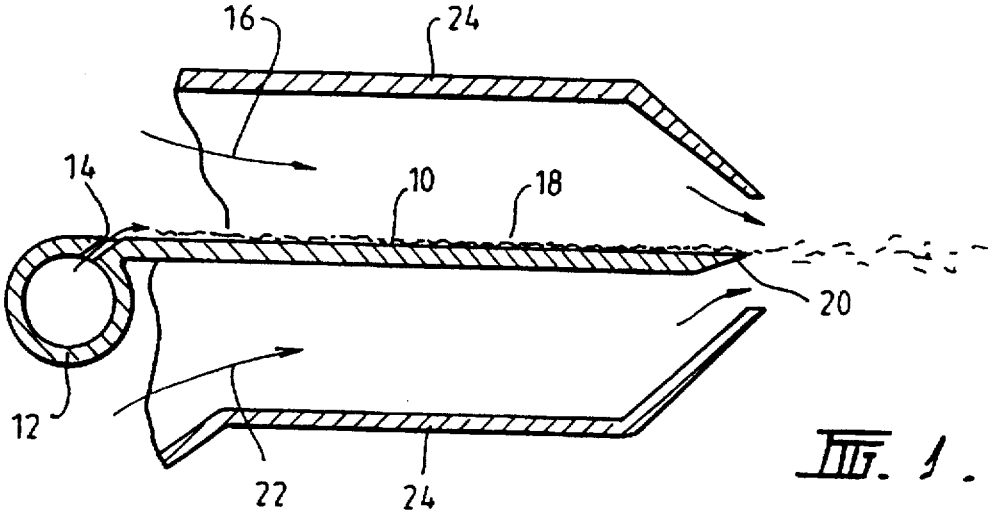
FIG. 1 illustrates schematically one form of gas particle formation apparatus.

A novel method of gas particle formation in a liquid media, as may be employed in the preferred embodiments of the present invention, will now be described with reference to FIG. 1. The method employs the principle of gas prefilming as illustrated in FIG. 1 on surface 10 which may be planar, circular, or conical as required. The structure illustrated in FIG. 1 in section view is partially or completely submerged in liquid media. A supply of gas through conduit 12 feeds onto the surface 10 via gas port 14, and due to the flow of liquid 16 over the surface 10 tends to form a thin film 18 on the latter. Surface 10 is provided with an edge 20 in the form of a lip towards which the flow of liquid 16, adjacent the gas film 18, flows over the surface 10. As the film of gas 18 escapes from the edge 20 of the surface 10 it is broken into gas particles by shear forces generated by the transfer of momentum between the liquid 16 and gas film 18.

Preferably a second flow of liquid 22 is generated which converges with the first flow 16 at the lip 20 of surface 10. The convergence of the cocurrent liquid flows 16, 22 enhances the shear forces generated between the gas film 18 and the liquid media as the gas film escapes from the lip 20 and subsequently mixes with the two streams of liquid. Typically the two streams of liquid 16, 22 have more dissimilar velocities and are accelerated towards the lip 20 together with the gas film 18. For this purpose baffles 24 are provided in the illustrated arrangement for regulating the passage of liquid 16 and 22 towards the lip 20. If the accelerating flow is also subjected to a continuous change in direction away from the gas prefilming surface 10 the liquid flow may break up the gas film into particles before lip 20 is reached.

It is by no means essential to have two liquid flows, and a single liquid flow 16 would also operate successfully. In this alternative arrangement the mass of liquid below the surface 10 would initially be substantially stationary, however as the gas film 18 and liquid 16 escape from the surface 10 at lip 20 liquid 22 below the surface 10 would be entrained with the stream of liquid and gas particles escaping from the lip 20. Typically the gas film 18 has a higher velocity than the liquid flows 16 and 22.

The size of the gas particles or bubbles formed before or at the lip 20 is largely determined by the relative velocities and qualities of the liquid flows 16 and 22 and the gas film 18. A typical mean bubble size of 0.5 mm can be achieved with liquid flow velocities of approximately 6 meters per second at a pressure drop in the range of 20–60 kPa, for a given device configuration. Gas particle sizes of between 50 micrometers to 2–3 mm can be achieved by varying the relative velocities of the liquid and gas. However, for constant liquid and gas velocity profiles the volume and distribution of gas particles produced by the illustrated method and structure remain substantially uniform.

Four different embodiments of a gas particle formation apparatus or aeration device will now be described with reference to FIGS. 2, 3, 4 and 5.

Figure 2A:
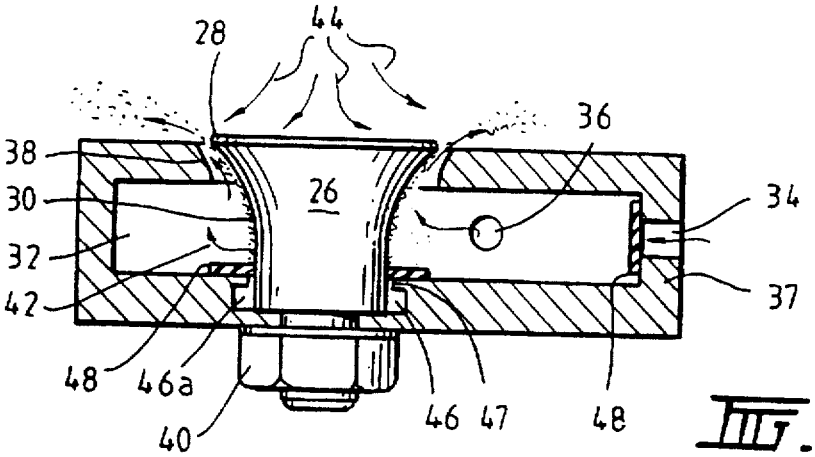
FIGS. 2A and B illustrate a preferred embodiment of an aeration unit shown in part section and plan view respectively.
Figure 2B:
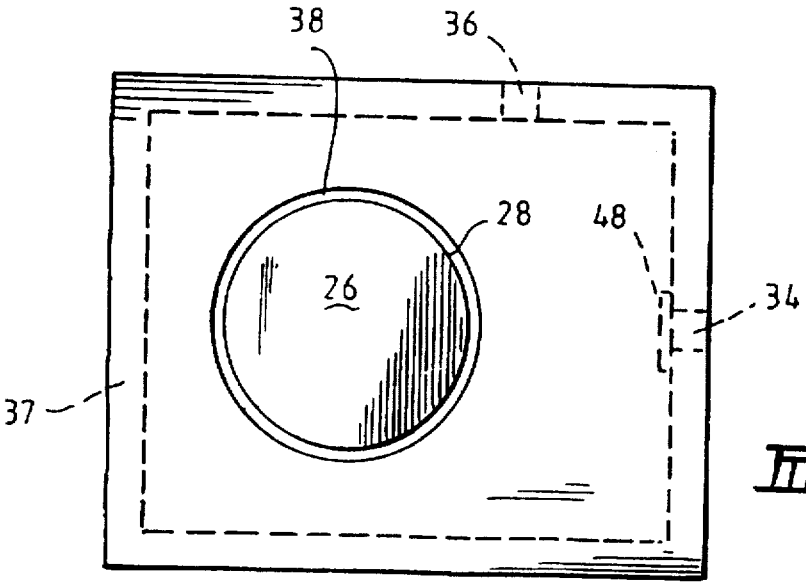

One preferred form of gas dispersion unit or aeration device, illustrated in FIG. 2, comprises a cylindrical body 26 having a circumferential edge flared outwardly defining an annular lip 28. The outer surface 30 of the body 26 is adapted to form a thin film of gas thereon. The gas prefilming body 26 is housed within a chamber 32 having a gas inlet 34 and a liquid inlet 36 provided in the walls 37 thereof. The walls 37 of chamber 32 are also provided with an outlet in the form of a circular aperture with an outer escape diameter slightly larger than an outer diameter of the annular lip 28. The gas prefilming body 26 is mounted in the chamber 32 with the outwardly flared edge received in the circular aperture so that an annular gap 38 is formed between the lip 28 and the inner circumference of the circular aperture. In this embodiment the body 26 is adjustable by means of nut 40 so that the width of the gap 38 can be varied as required.

Liquid enters the chamber 32 via inlet 36 in a tangential manner creating a swirling effect around the stem of the body 26. Gas entering inlet 34, being lighter, is forced to concentrate around the outer surface 30 of the body 26 due to centrifugal forces such that the liquid flow ensuing through the gap 38 forces the gas stream to form a thin film on the outer surface 30. Both liquid and gas are forced through the gap 38 and as the gas film escapes from the lip 28 of the body 26 it is broken into gas particles which subsequently mix with both the prefilming liquid flow 42 and the ejected or shearing flow 44.

Gas may also be injected into the chamber 32 onto the outer surface 30 of the body 26 in an annular or plan fashion through scroll 46, **46*a*. With this alternative method of gas injection it is not necessary for the liquid to enter the chamber in a tangential manner to create the swirling effect, since the gas can be injected directly onto the outer surface 30 of the body 26. In the latter method employed to feed the gas onto the outer surface 30 of the body 26, the gas entry port 47 is covered with resilient or elastic material 48 serving the double function of providing a non-return seal and also enhancing the prefilming effect. In the former method the elastic material 48 provides a non-return seal over gas inlet 34. The position of gas prefilming body 26** can be adjusted manually or automatically for the purpose of obtaining constant or variable gas particle sizes at various liquid/gas ratios and pressures, thereby maintaining a liquid pressure drop between inlet and device discharge within such limits as to obtain the desired gas particle size and subsequent mixing/turbulence parameters.

Figure 3:
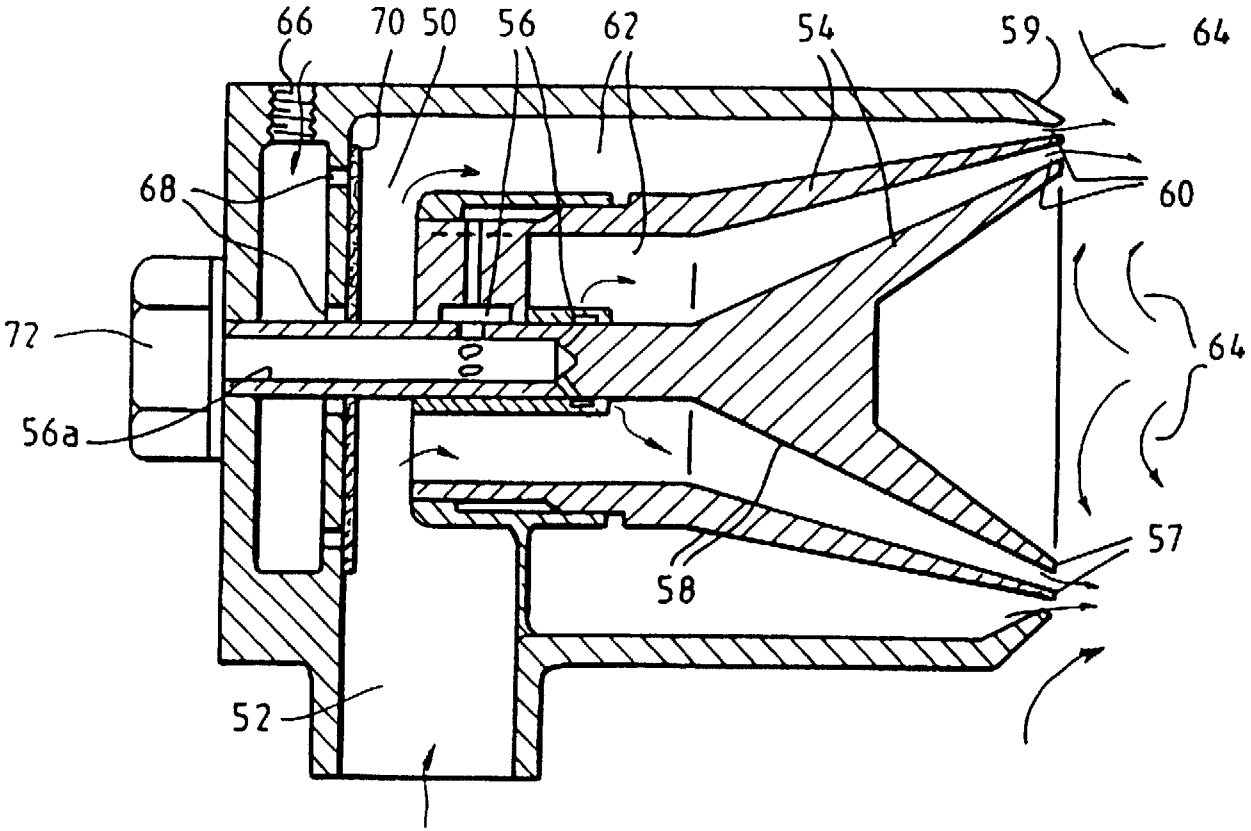
FIG. 3 illustrates in section view another embodiment of an aeration device.

In the second embodiment of a gas dispersion unit illustrated in FIG. 3, liquid enters a chamber 50 also in a tangential manner from liquid inlet 52. Housed within the chamber 50 are a pair of concentrically mounted, hollow frusto-conical bodies 54. Gas inlets 56, **56*a* inject gas into the chamber 50 directly onto the outer surfaces 58 of the gas prefilming bodies 54 in a region of decreasing static pressure gradient. As in the previous embodiment, the gas is forced to concentrate around the outer surfaces 58 of the bodies 54 due to centrifugal forces such that the liquid flow through spaces 62 and further ensuing through the gaps 60 forces the gas stream to form thin films on the outer surfaces 58 of the bodies 54. The hollow bodies 54 are mounted concentrically within the chamber 50 such that the outer circumferential escape edges or lips 57 of bodies 54, together with a peripheral escape edge of the cylindrical wall 59 of chamber 50, form annular gaps 60 through which the liquid and gas can escape from the gas dispersion unit in a specified manner and with the required velocity profile. The gas films formed on the outer surfaces 58 of the bodies 54 are broken into gas particles as they escape from the lips 57, subsequently mixing with both the prefilming liquid flow 62 and the shearing flow 64. Obviously, gas may be fed to either one or both surfaces 58 of the hollow bodies 54**.

In the case where liquid enters through inlet 52 in a tangential manner, gas can also be injected directly into the liquid stream in chamber 50 through alternate gas inlet 66. As with the previous embodiment, the gas entry ports 68 may be covered with elastic material 70 which serves the double function of providing a non-return seal and enhancing the prefilming effect. The size of the gaps 60 may be varied by adjusting the position of the bodies 54 within chamber 50 using nut 72. Hence, as with the previous embodiment the desired gas particle size and subsequent mixing/turbulence parameters can be controlled at various liquids/gas ratios by adjusting the relative positions of the frusto-conical bodies 54 and the walls 59 of chamber 50 either manually or automatically.

Although, as described above, the gas dispersion unit illustrated in section view in FIG. 3 is of circular or cylindrical configuration, FIG. 3 with minor modifications can also represent a section view through a gas dispersion unit of linear or planar configuration. In this alternative arrangement the walls 59 of chamber 50 would be substantially planar extending perpendicularly out of the page, and the bodies 54 would be in the form of planar blades or vanes also extending perpendicularly out of the page. Prefilming of the surfaces 58 of the bodies 54 would not be due to the swirl effect created by tangential liquid flow, but rather due to gas injection directly onto the surfaces 58 through gas inlets 56 and gas ports 68, with the elastic material 70 providing enhanced prefilming. Obviously one or more bodies 54 may be employed to form gaps 60 with the walls 59 of chamber 50 or with adjacent bodies. A plurality of prefilming bodies 54 has the advantage of providing increased gas prefilming surface area and greater control flexibility.

Figure 7:
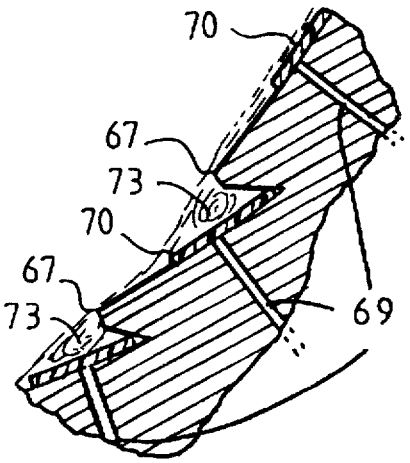
FIG. 7 illustrates a portion of the aeration device shown in FIG. 4.
Figure 4:
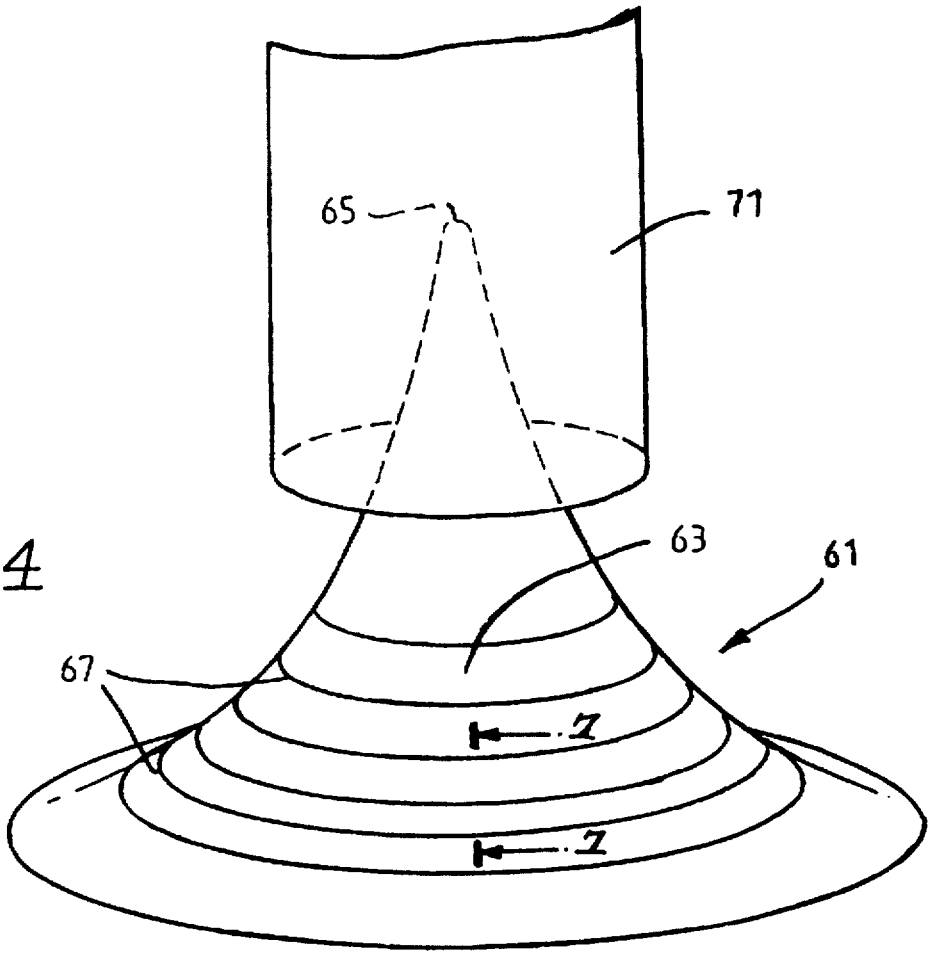
FIG. 4 illustrates yet another embodiment of an aeration device.

A prefilming body of circular or cylindrical configuration having a circumferential edge flared outwardly in the general direction of the flow is particularly advantageous because the prefilming surface thus formed is of increasing circumferential surface area. Thus the gas film becomes thinner as it flows towards the outwardly flared edge, further enhancing the prefilming effect. FIG. 4 illustrates a third embodiment of a gas dispersion unit or gas particle formation apparatus. This embodiment comprises a gas prefilming body 61 of coniform configuration in which an outer circumferential surface 63 tapers in a curved manner to a point 65. The outer surface 63 is provided with at least one circumferential ridge 67 forming an edge or lip of the surface whereby, in use, a film of gas formed on the surface 63 can be broken into gas particles as it escapes from the lip 67, by shear forces generated between the gas film and an adjacent flow of liquid directed toward said edge. Preferably the outer surface 63 is provided with a plurality of circumferential ridges 67, as can be seen more clearly in the enlargement in FIG. 7, the ridges being formed by a plurality of outer surface portions 63 arranged in a cascade as shown. Gas is directed onto the surface portions 63 via inlets 69 which are covered with resilient or elastic material 70, as in the previous embodiments, which serves to enhance the prefilming effect and provide a nonreturn seal.

The whole prefilming body 61 is typically submerged in a liquid medium, for example a liquid/slurry, and pointed towards the mouth of liquid feed pipe 71, through which liquid is pumped. The liquid escaping from pipe 71 is fed onto the outer surface 63 of the body 61, and flows over the surface portions 63 in a cascade fashion. Due to the curvature of the outer surface 63 centrifugal forces cause the flow of liquid to exert a pressure on the film of gas formed on each surface portion 63, which in turn produces an acceleration of the gas film towards the lip 67. As the gas film escapes from lip 67 shear forces produced by a transfer of momentum between the gas film and the flow of liquid cause the gas film to be broken into gas particles which, being lighter, tend to be pushed away from the surface 63 to be dispersed into the surrounding liquid media to provide aeration.

Immediately below each ridge or lip 67 a vortex 73 is created which provides a second recirculating flow of liquid which converges with the above described flow at or near the lip 67, to enhance the shearing effect. The above described embodiment is particularly advantageous since it does not require any additional chamber or baffles surrounding the prefilming body 61, in order to generate a suitable flow of liquid over the outer surface 63.

Figure 5:
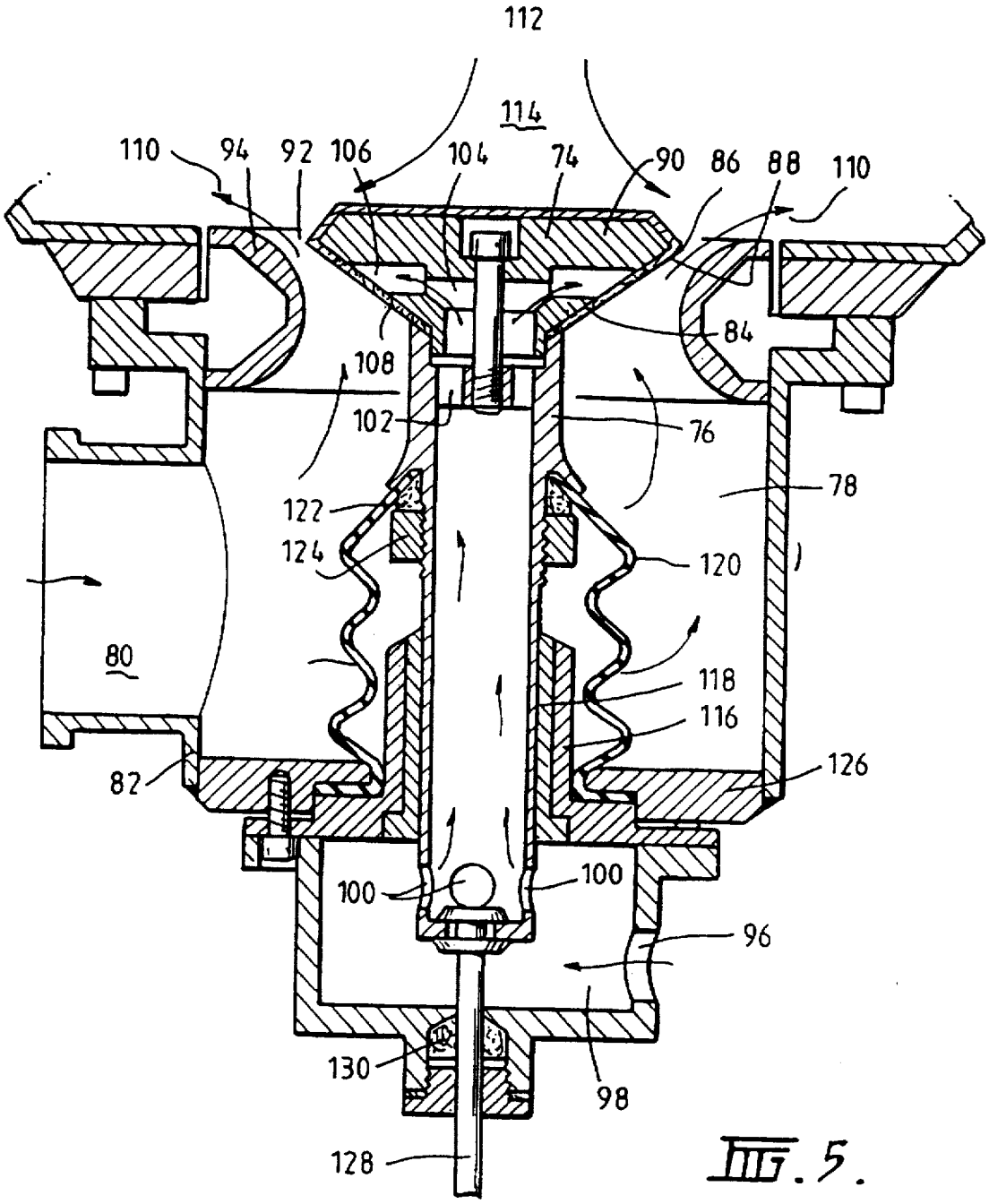
FIG. 5 illustrates a still further embodiment of an aeration device.

FIG. 5 illustrates a still further embodiment of an aeration device according to the present invention, in which a circular prefilming body 74, in the form of an adjustable hollow stem 76, is housed within a liquid chamber 78 having a liquid inlet 80 provided in the wall of the casing 82 thereof. The stem 76 has a head 90 provided with an outwardly flared frusto-conical surface 84 having a circumferential edge defining an annular lip 86 thereon. A portion 88 of the frusto-conical surface 84 is adapted to form a thin film of gas thereon. The casing 82 of the liquid chamber 78 is also provided with a liquid outlet in the form of a circular aperture with an outer escape diameter slightly larger than an outer diameter of the annular lip 86. The adjustable stem 76 is slidably mounted in the casing 82 with the frusto-conical surface 84 of the head 90 received in the circular aperture so that an annular gap 92 is formed between the surface 84 and a convex annular lip 94 of the circular aperture forming the liquid outlet in the casing 82.

In use, gas enters inlet 96 of gas chamber 98, passes through apertures 100 into the hollow stem 76. The gas rises through the hollow stem 76 and passes through apertures 102 into a chamber 104 within the head 90 of the prefilming body 74. The gas is then delivered through distribution outlets 106 onto the prefilming surface portion 88 of the frusto-conical surface 84. The distribution outlets 106 are covered by a self-sealing resilient or elastic spreader 108, typically in the form of an annular rubber washer, which serves the double function of providing a non-return seal and also enhancing the prefilming effect. In use, both liquid/slurry and gas are forced through the gap 92 and as the gas film escapes from the lip 86 it is broken into gas particles which subsequently mix with both the prefilming liquid flow 110 and the recirculating or shearing flow from volume 114 above the head 90. The difference in flow velocity between the slurry and the gas film creates wavelets at the liquid/gas interface in gap 92, and the curvature of convex lip 94 continuously changes the direction of the flow generating centrifugal forces that produce migration of solid particles present in the slurry away from the lip 94. The migrating solid particles then penetrate the gas film and strike the prefilming surface portion 88 on head 90 as well as passing through the broken-up gas film after it escapes into the volume 114 of gas/slurry mixture above the head 90. Hence, each solid particle that passes through the gas film and rejoins the slurry flow in volume 114 will entrain a gas particle thereby producing the required gas dispersion and bubble size enhancing the shearing effect. Both the convex lip 94 and the prefilming surface portion of the head 90 are coated with an abrasion resistant coating, for example, a ceramic coating.

The slurry pressure differential between chamber 78 and volume 114 can be adjusted between 10 kPa and 100 kPa by varying the height of stem 76 guided by a sliding assembly formed by a guide 116, which may be provided with a removable sleeve 118 to form an air tight seal between the stem 76 and guide 116. This arrangement is protected from slurry ingress by a flexible bellows 120 held at one end by a compression washer 122 and nut 124 on stem 76, and at the other end by a flange, provided on guide 116, and a bottom plate 126 of the casing 82. The actuating mechanism for positioning the stem 76 (not illustrated) can be manual or automatic, and is protected from slurry ingress into gas chamber 98 through the hollow stem 76 by the self-sealing spreader 108 made of resilient material. The self centring rod 128 protrudes from chamber 98 through gland 130. The air feed pressure in chamber 98 is typically equal or slightly above the slurry pressure in chamber 78.

In this embodiment of the aeration device, the bubble size can be controlled by varying the gap 92 as a function of the proportion of solids in the slurry between operational values of, for example, 0 and 75%. The pressure differential between chamber 78 and volume 114 can be varied such that bubble sizes in the dimensional range of between 0.2 to 3.0 mm can be obtained for slurry velocities in the gap 92 of between 1.5 and 12 meters per second and gas velocities in the gas film formed on surface 88 of up to 340 meters per second. The resulting swarm of gas particles or bubbles mixes uniformly with the ensuing slurry flow from gap 92 and the recirculating flow 112 from the volume 114 of slurry/gas mixture such that the ratio between the dispersed gas volume and the slurry passing through the device can be as high as 6:1.

The embodiment of the gas dispersion device illustrated in FIG. 5 is provided with only one prefilming body 74. However, in order to increase the prefilming surface area an additional prefilming body (or bodies) may be provided in the form of an annulus concentric with the prefilming body 74.

The above described gas dispersion units can be used in conjunction with flotation apparatus for mineral or coal enrichment processes to achieve enhanced performance with minimum energy consumption. Indeed, it has been found that a flotation process can be driven entirely by the gas energy generated by an aeration unit of sufficient capacity. Any commercially available aeration unit may be employed suitably modified and sized in the flotation column, although it has been found that an aeration unit of the kind described above is particularly suitable in view of the high gas lift generated. Examples of other known aeration units which may be used are those manufactured by Ekof or Zultzer.

A flotation apparatus which employs a gas dispersion unit similar to that described above will now be described.

Figure 6:
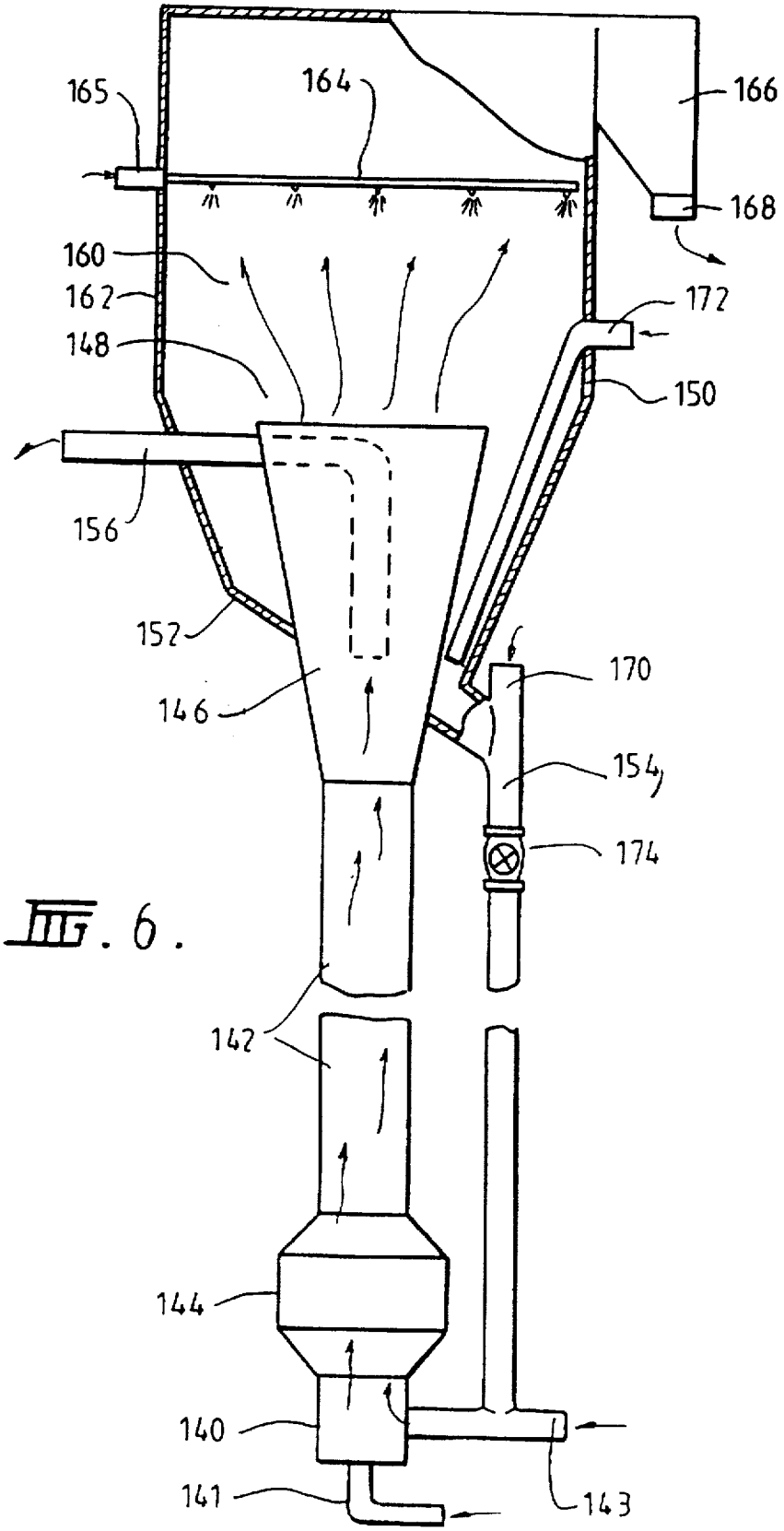
FIG. 6 illustrates one embodiment of a flotation apparatus according to the invention which incorporates the aeration device of FIG. 5.

The flotation apparatus illustrated in FIG. 6 employs a gas dispersion unit or aerator 140, similar to that illustrated in FIG. 5, at the lower end of an elongate riser 142. Gas is injected into the aeration unit 140 through gas inlet 141 and slurry is fed to the unit 140 through slurry feed pipe 143. Riser 142 may be constructed from a variety of materials including high density polypropylene (HDP) pipe sections joined end to end up to a length of 30 meters. Between the riser 142 and gas dispersion unit 140 there is provided a reactor vessel 144 of larger diameter than the bulk of the riser 142. The reactor vessel 144 is typically manufactured of heavy gauge mild steel sheet with a ceramic coating on the inside. The aeration unit 140 discharges into the reactor producing high shear velocities of up to 10.0 meters per second. The gas bubbles with entrained particles escape from the aeration unit 140 typically in a radial direction and are dispersed uniformly throughout the slurry/gas mixture in reactor 144. Reactor 144 is of enlarged diameter to facilitate uniform dispersion but to prevent recombination of the gas particles to form larger bubbles, such that most of the flow kinetic energy is dissipated within its volume. The reactor 144 is thus normally the only part of the flotation apparatus where intense turbulence is present, the rest of the flows within the unit being predominantly quiescent. The gas/slurry mixture rises up through the riser 142 and through a flared end section 146 at the top of the riser, in such a way that when the gas/slurry mixture escapes into the volume 148 of the separation unit 150 it slows down sufficiently for the gas bubbles to separate from the slurry liquid at the discharge mouth of the riser 142. The unattached slurry liquid separates from the froth and drains into the outer vessel 152 from which it can be either recirculated back into the aeration unit 140 as non-aerated pulp through recirculation line 154 or removed as tailings through line 156.

The flow of gas/slurry mixture in the riser 142 is typically turbulence-free or laminar flow and provides the necessary conditions for efficient mineral collection. Bubbly flow conditions are maintained at all times with an air lift figure of up to 85%, more typically between 50 to 70%. The velocity of the gas/slurry mixture in the riser 142 is maintained within the range 0.1–2.0 meters per second, more typically between 0.3–1.0 meters per second. Due to the low discharge pressure "seen" by the aeration unit 140, as a direct result of such high air lift values, coupled with the full slurry column pressure at the liquid inlet of the aeration unit, sufficient pressure drop is produced to generate the gas bubble dispersion and recirculation of the slurry through the flotation apparatus, thereby using the gas energy to drive the whole process. The mouth of the outer vessel 152 is sufficiently large relative to the mouth of the riser 142 so that the non-aerated slurry velocity is kept low enough to prevent re-entrainment of gas into the recirculation circuit or tailings discharge.

Thus, the flotation apparatus of FIG. 6 includes means for generating substantially turbulence free flow in which a high gas lift occurs in the riser 142 such that a pressure drop between the liquid inlet 143 and the discharge outlet of the aeration unit 140 is sufficient to produce gas particle dispersion and recirculation of the slurry liquid through the flotation apparatus.

The pulp level within the outer vessel 152 is maintained below the discharge mouth of the riser 142 by a weir arrangement formed by the tailings outlet line 156. The atmospheric discharge of the tailings line 156 is so positioned that the recombined pulp level in the outer vessel 152 is never above the mouth of the flared end section 146 of the riser 142, and typically 0.05 to 0.25 meters below, such that the riser bottom pressure is not increased by pulp reingestion which could generate turbulence, and recirculation is avoided in the riser.

The froth discharged from the riser forms a deep froth layer 160 rising through a parallel duct 162 connected to a top flange of the outer vessel 152. The froth duct 162 may be partitioned vertically to prevent froth macro recirculation which could result in substantial loss of values. Froth height can be varied by removing one or more sections which form the froth duct 162 or by having froth duct of variable height.

Above the froth duct 162 is a froth wash system 164 in which the froth is washed by a dispersed flow of water mixed with additives from a manifold fed through port 165. The froth wash system 164 may be combined with a froth removal system 166 which collects the final concentrate to drain from outlet 168 for storage and/or further processing.

The slurry pressure drop can be varied by increasing/decreasing the prefilming gap in the aeration unit 140, thereby controlling the bubble size at the same time as the recirculation rate. The flotation unit is typically sized such that the volume of slurry recirculated is 4 to 20 times the likely slurry feed flow, which is a significant advantage over the current practise of "single pass", thereby improving the values attachment probability and therefore improved recovery of slow floting values. Furthermore, as the slurry flow rate through the aerator is dictated solely by the operating pressure drop its value is not affected by variations in feed flow since the recirculated flow of slurry varies to compensate, thereby maintaining unchanged gas dispersion characteristics. An added advantage resulting from the abovementioned features is that the flotation apparatus exhibits typically short residence times, for example between 30–120 seconds.

An alternative feed method for the pulp is to use feed inlets 170 at the top of the recirculation line 154, and/or to use feed pipe 172 feeding directly into the vessel 152. Feed pipe 172 can be used provided the feed discharge into the top of the recirculation line 154 is totally decoupled from the entry to the tailings outlet line 156. The recirculation line 154 can he provided with a control valve 174 to control the flow of slurry fed to the aeration unit 140.

The flotation apparatus of FIG. 6 employs only one aeration unit 140, however two or more aeration units each with its own riser could be employed if desired. Each unit would typically be provided with its own reactor vessel for gas dispersion. One or more risers can be incorporated in a flotation apparatus if desired. Furthermore, the basic principle of having an aeration unit with reactor and riser could be employed with a conventional flotation column by having the riser located adjacent the column with concentrated slurry from the column's quiescent zone just under the pulp/froth interface being recirculated therethrough. The riser could also be located within the column of a conventional flotation apparatus suitably modified.

A significant advantage of driving the flotation apparatus/process using the gas energy only is that no slurry pumps are required. Slurry pumps are expensive and require regular maintenance due to high wear of components.

Now that preferred embodiments of the flotation process and apparatus have been described in detail, it will be apparent to those skilled in the relevant arts that numerous variations and modifications may be made to the described embodiments, other than those already described, without departing from the basic principles of the inventions. For example, in some applications the use of a slurry pump may still be advantageous in conjunction with the gas energy to effect recirculation of the slurry liquid.

All such variations and modifications are to be considered within the scope of the present invention, the nature of which is to be determined from the foregoing description and appended claims.

The claims defining the invention are as follows:

1. A flotation apparatus comprising:

an elongate vertical riser in which a cocurrent flow of gas/slurry liquid mixture rises upwards to a discharge mouth at its top end;

an aeration unit provided at a lower end of the riser for aerating said cocurrent flow of gas/slurry liquid mixture in the riser, the aeration unit having a liquid inlet, a gas inlet and a discharge outlet and wherein the size of gas particles produced by the aeration unit is controlled by means for regulating the pressure drop between the liquid inlet and the discharge outlet of the aeration unit;

a separation unit provided at the top end of the riser in which gas particles separate from the gas/slurry liquid mixture at the discharge mouth of the riser to form a froth layer above the discharge mouth, and having a recirculation line through which unattached slurry liquid separated from the froth is recirculated to said liquid inlet of the aeration unit; and, wherein the height of the riser is selected to produce substantially turbulence free flow in which a high gas lift occurs in said riser such that the pressure drop between the liquid inlet and the discharge outlet of the aeration unit is sufficient to produce gas particle dispersion and recirculation of the slurry liquid through the flotation apparatus.

2. A flotation apparatus as claimed in claim 1, further comprising a reactor vessel provided between the aeration unit and the riser, said reactor vessel having a larger cross-sectional area than the bulk of said riser to facilitate uniform gas dispersion, but to minimise recombination of gas particles in a gas/slurry liquid mixture formed therein.

3. A flotation apparatus as claimed in claim 1, wherein the riser has a flared end section at its upper end adapted to further slow down the flow of the gas/slurry liquid mixture rising in the riser whereby, in use, the mixture slows down sufficiently for gas particles in the form of froth to separate from the slurry liquid at said discharge mouth of the riser.

4. A flotation apparatus as claimed in claim 1, wherein said separation unit comprises an outer vessel into which unattached slurry separated from the froth can drain, and from which it can be either recirculated to the liquid inlet of the aeration unit through said recirculation line or removed as tailings through a tailings discharge line.

5. A flotation apparatus as claimed in claim 4, wherein the airlift generated in the riser exerts a sufficiently low pressure at the discharge outlet of the aeration unit such that the required bubble size, gas dispersion and slurry recirculation are obtained due to the pressure differential obtained between the liquid inlet to the aeration unit pressurised by a height of recombined slurry substantially the same as a height of said riser.

6. A flotation process comprising the steps of:

aerating a cocurrent flow of gas/slurry mixture rising upwards in an elongate vertical riser;

generating substantially turbulence free flow in which a high gas lift occurs in said riser from gas particles formed by an aeration unit having a liquid inlet, a gas inlet and a discharge outlet;

regulating the pressure drop between said liquid inlet and said discharge outlet of the aeration unit to control the size of gas particles produced by the aeration unit;

separating said gas particles from the gas/slurry liquid mixture at a top end of the riser to form a froth layer above the riser;

recirculating unattached slurry liquid separated from the froth to the liquid inlet of the aeration unit; and, selecting the height of the riser such that the pressure drop between said liquid inlet and said discharge outlet of the aeration unit is sufficient to produce gas particle dispersion and said recirculation of the slurry through the flotation apparatus, thereby using the gas energy to drive the process.

7. A flotation process as claimed in claim 6, further comprising the step of facilitating uniform gas dispersion whilst inhibiting recombination of gas particles adjacent the discharge outlet of the aeration unit, such that most of the kinetic energy of the gas particles is dispersed before they enter the riser.

8. A flotation process as claimed in claim 6, further comprising the steps of further slowing down the flow of gas/slurry mixture rising in the riser as it approaches a discharge mouth of the riser.

9. A flotation process as claimed in claim 6, wherein said gas/slurry mixture includes a volume of fresh slurry fed to the process, and wherein the volume of slurry liquid recirculated is between 4 to 20 the volume of fresh slurry fed to the process, thereby increasing the probability of values attachment to the gas particles.

10. A flotation apparatus as claimed in claim 1, wherein means are provided to maintain the level of the gas/slurry liquid mixture below the discharge mouth of the riser such that reingestion of slurry liquid in the riser is avoided.

* * * * *